United States Patent [19]

Schmidt et al.

[11] Patent Number: 4,757,229

[45] Date of Patent: Jul. 12, 1988

[54] CHANNEL ELECTRON MULTIPLIER

[75] Inventors: Kenneth C. Schmidt, Wilbraham; James L. Knak, West Springfield, both of Mass.

[73] Assignee: K and M Electronics, Inc., West Springfield, Mass.

[21] Appl. No.: 932,267

[22] Filed: Nov. 19, 1986

[51] Int. Cl.[4] ..... H01J 43/04; H01J 43/28

[52] U.S. Cl. ..... 313/103 CM; 313/105 CM

[58] Field of Search ..... 313/103 CM, 105 CM

[56] References Cited

U.S. PATENT DOCUMENTS

| | | | |
|---|---|---|---|
| 3,128,408 | 4/1964 | Goodrich et al. | 313/103 |
| 3,224,922 | 4/1966 | Wolfgang | 313/95 |
| 3,612,946 | 10/1971 | Toyoda | 313/105 |
| 3,790,840 | 2/1974 | Toyoda | 313/105 |
| 4,095,132 | 6/1978 | Fraioli | 313/103 CM |

FOREIGN PATENT DOCUMENTS

| | | | |
|---|---|---|---|
| 1121858 | 4/1982 | Canada | 313/103 CM |

OTHER PUBLICATIONS

Vacumetrics, Inc. Catalog 1984/85, pp. 40–41.

*Primary Examiner*—David K. Moore
*Assistant Examiner*—Sandra L. O'Shea
*Attorney, Agent, or Firm*—Lahive & Cockfield

[57] ABSTRACT

A channel electron multiplier having a semiconductive secondary emissive coating on the walls of said channel wherein said electron multiplier is a monolithic ceramic body and said channel therein preferably is three dimensional.

9 Claims, 2 Drawing Sheets

CHANNEL ELECTRON MULTIPLIER

BACKGROUND OF THE INVENTION

The invention relates to a channel electron multiplier made from a monolithic ceramic body and a method of making same. In particular it relates to a channel electron multiplier wherein said channel provides a preferably three dimensional, curved conduit for increased electron/wall collisions and for a device of smaller dimension, particularly when longer channel length is required.

Electron multipliers are typically employed in multiplier phototubes where they serve as amplifiers of the current emitted from a photocathode when impinged upon by a light signal. In such a multiplier phototube device the photocathode, electron multiplier and other functional elements are enclosed in a vacuum envelope. The vacuum environment inside the envelope is essentially stable and is controlled during the manufacture of the tube for optimum operational performance. The electron multiplier in this type of application generally employes a discreet metal alloy dynode such as formed from berylium-copper or silver-magnesium alloys.

There are other applications for electron multipliers that do not require a vacuum envelope. Such applications are, for example, in a mass spectrometer where ions are to be detected and in an electron spectrometer where electrons are to be detected. In these applications the signal to be detected, i.e. ions or electrons, cannot penetrate the vacuum envelope but must instead impinge directly on the dynode surface of a "windowless" electron multiplier.

Electron multiplier with discreet metal alloy dynodes are not well suited for "windowless" applications in that secondary emission properties of their dynodes suffer adversely when exposed to the atmosphere. Furthermore, when the operating voltage is increased to compensate for the loss in secondary emission characteristics, the discreet dynode multiplier exhibits undesirable background signal (noise) due to field emission from the individual dynodes. For these reasons, a channel electron multiplier is often employed wherever "windowless" detection is required.

U.S. Pat. No. 3,128,408 to Goodrich et al discloses, a channel multiplier device comprising a smooth glass tube having a straight axis with an internal semiconductor dynode surface layer which is most likely rich in silica and therefore a good secondary emitter. The "continuous" nature of said surface is less susceptible to extraneous field emissions, or noise, and can be exposed to the atmosphere without adversely effecting its secondary emitting properties.

Smooth glass tube channel electron multipliers have a relatively high negative temperature coefficient of resistivity (TCR) and a low thermal conductivity. Thus, they must have relatively high dynode resistance to avoid the creation of a condition known as "thermal runaway". This is a condition where, because of the low thermal conductivity of the glass channel electron multiplier, the ohmic heat of the dyode cannot be adequately conducted from the dynode, the dynode temperature continues to increase, causing further decrease in the dynode resistance until a catastrophic overheating occurs.

To avoid this problem, channel electron multipliers are manufactured with a relatively high dynode resistance. If the device is to be operable at elevated ambient temperature, the dynode resistance must be even higher. Consequently, the dynode bias current is limited to a low value (relative to discreet dynode multipliers) and its maximum signal is also limited proportionately. As a result, the channel multiplier frequently saturates at high signal levels and thus does not behave as a linear detector. It will be appreciated that ohmic heating of the dynode occurs as operating voltage is applied across the dynode. Because of the negative TCR, more electrical power is dissipated in the dynode, causing more ohmic heating and a further decrease in the dynode resistance.

In an effort to alleviate the deficiences of the typical glass tube channel multiplier, channel multipliers formed from ceramic supports have been developed. Such devices are exemplified in U.S. Pat. No. 3,244,922 to L. G. Wolfgang, U.S. Pat. No. 4,095,132 to A. V. Fraioli and U.S. Pat. No. 3,612,946 to Toyoda.

As shown and described in U.S. Pat. Nos. 3,244,922 and 4,095,133, the electron multiplier is formed from two sections of ceramic material wherein a passageway or conduit is an elongated tube cut into at least one interior surface of the two ceramic sections. While such a channel can be curved as shown in the patent to Fraioli or undulating as shown in the patent to Wolfgang, each is limited to a two-dimensional configuration and thus may create only limited opportunities for electron/wall collisions.

In U.S. Pat. No. 3,612,946, a semi conducting ceramic material serves as the body and the dynode surface for the passage contained therein. For this device to function as an efficient channel electron multiplier, the direction of the longitudinal axis of its passage must essentially be parallel to the direction of current flow through the ceramic material, such current flow resulting from the application of the electric potential required for operation.

The present invention is an improvement of the channel multipliers of the prior art discussed above in that it combines the beneficial operation of the glass tube-type channel multiplier and the discreet dynode multiplier and adds a ruggedness and ease of manufacture heretofore unknown.

Accordingly, it is an object of the present invention to provide a channel electron multiplier which has a high gain with a minimum of background noise.

It is another object of the present invention to provide a channel multiplier which is formed from a monolithic ceramic body for the efficient dissipation of heat.

It is another object of the present invention to provide a channel multiplier having a dynode layer formed from a semiconducting material having good secondary emitting properties.

It is another object of the present invention to provide a channel multiplier having a 3-dimensional passageway therethrough so as to optimize electron/wall collisions and to provide for longer channels in a compact configuration.

It is a further object of the present invention to provide a method of making a channel multiplier having a 3-dimensional passageway therethrough.

It is another object of the present invention to provide a rugged, easily manufactured channel multiplier.

It is a further object of the present invention to provide a channel multiplier which can also serve as the insulating support for electrical leads, mounting brackets, aperture plates and the like.

The above and other objects and advantages of the invention will become more apparent in view of the following description in terms of the embodiments thereof which are shown in the accompanying drawings. It is to be understood, however, that the drawings are for illustration purposes only and not presented as a definition of the limits of the present invention.

DESCRIPTION OF THE DRAWINGS

Referring now to the drawings, wherein like elements are numbered alike in the several FIGURES.

DESCRIPTION OF THE PREFERRED EMBODIMENTS

Figure 1:
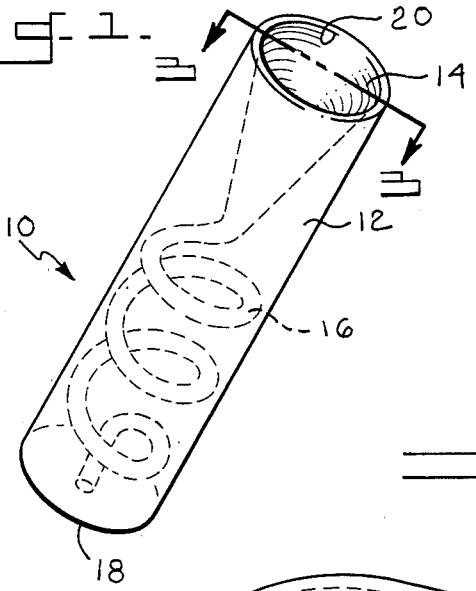
FIG. 1 is a perspective view of a channel electron multiplier of the present invention.
Figure 3:
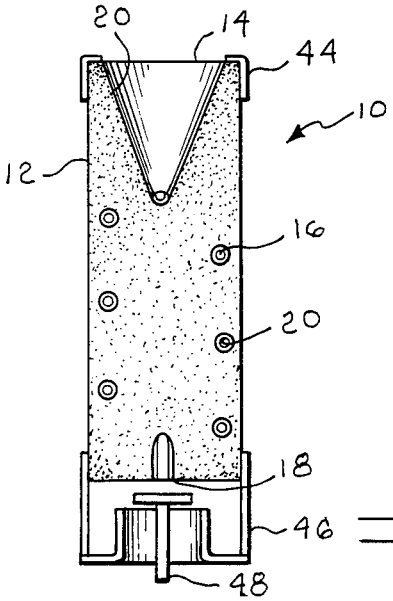
FIG. 3 is a sectional view taken along lines 3—3 of FIG. 1 with additional support and electrical elements thereon.

Referring to FIG. 1 and 3, a channel multiplier constructed in accordance with the present invention is shown at 10. It is comprised of a monolithic electrically insulating, ceramic material. It will be appreciated that the problems of registration and seams in the channel passage, as disclosed, for example in the above-discussed U.S. Pat. Nos. 3,224,927 and 4,095,132, are obviated by the monolithic body.

In the embodiment shown in FIGS. 1 and 3, the monolithic body 12 of the multiplier is cylindrical in shape. As will be further noted, one end of said body may be provided with a cone or funnel shaped entryway or entry port 14 which evolves to a hollow passageway or channel 16. The channel 16 preferably is three dimensional and may have one or more turns therein which are continuous throughout the body 12 of the multiplier 10 and exits the multiplier 10 at an exit port at the opposite end 18 of the cylinder shaped body from the entryport 14. It will also be appreciated that the passage of the channel must be curved in applications where the multiplier gain is greater than about $1\times10^6$ to avoid instability caused by "ion feedback".

The surface 20 of the funnel shaped entryway 14 and the hollow passageway 16 is coated with a semiconducting material having good secondary emitting properties. Said coating is hereinafter described as a dynode layer.

FIG. 3 is a modified version of FIG. 1, wherein an input collar 44 is press fit onto the ceramic body 12 and is used to make electrical contact with entry port 14. An output flange 46 is also pressed onto the ceramic body 12 and is used to position and hold a signal anode 48 and also to make electrical contact with exit port 18.

Figure 2:
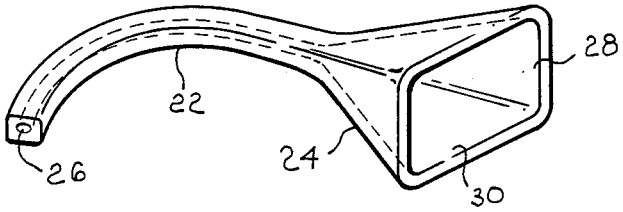
FIG. 2 is a perspective view of an embodiment of the present invention.

With reference to FIG. 2 the embodiment shown may be described as a free form channel multiplier. In said embodiment, the multiplier 10, comprises a tube-like curved body 22 having an enlarged funnel-shaped head 24. A passageway 26 is provided through the curved body 22 and communicates with the funnel-shaped entrance way 28. It will be appreciated that passageway 26 of FIG. 2 differs from passageway 16 of FIG. 1 in that passageway 26 comprises a two-dimensional passage of less than one turn. It is believed that the FIG. 1 embodiment may be preferable over the FIG. 2 embodiment depending on volume or packaging considerations. As in the embodiment of FIGS. 1 and 3, the surface 30 of the passageway 26 and entrance way 28 are coated with a dynode layer.

Figure 4:
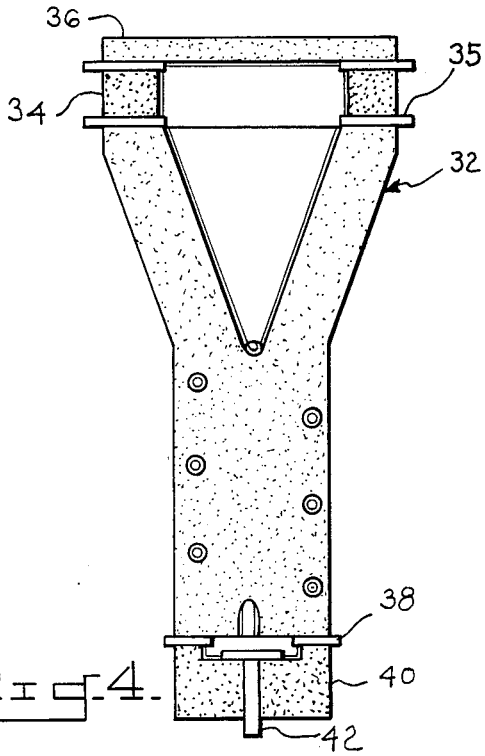
FIG. 4 is a sectional view, similar to that shown in FIG. 3, of a modified version of the channel electron multiplier of the present invention.

FIG. 4 discloses a further embodiment of the present invention wherein the channel multiplier 10 has the same internal configuration as that shown in FIGS. 1 and 3, but has different external configuration in that the body 32 is not in the form of a cylinder. For reasons to be explained below relating to the method of manufacturing the channel multiplier of the present invention, almost any desired shape may be employed for said multiplier.

Figure 5:
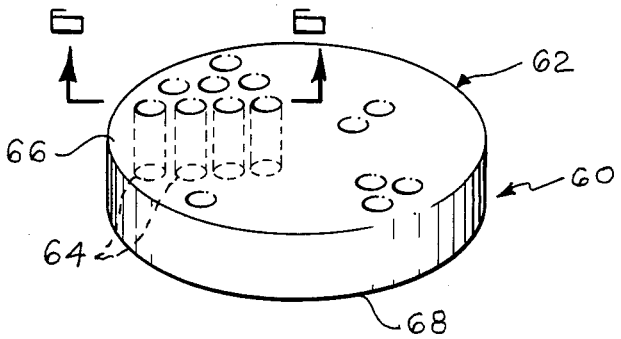
FIG. 5 is a perspective view of yet another channel electron multiplier of the present invention.
Figure 6:
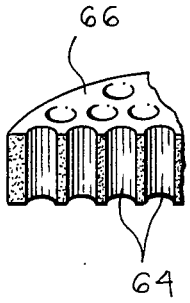
FIG. 6 is a cross-sectional elevation view along the line 6—6 of FIG. 5.

Turning now to FIGS. 5 and 6, an alternative embodiment of the present invention employing a plurality of hollow passageways or channels therein is shown generally at 60. Channel electron multiplier 60 is comprised of a unitary or monolithic body 62 of ceramic material with a multiplicity of hollow passages 64 interconnecting front and back surfaces 66, 68 of body 62. It will be appreciated that passages 64 may be straight, curved in two dimensions, or curved in three dimensions. Preferably, front and back surfaces 66, 68 are made conductive by metallizing them, while a dynode layer is coated on the passageways.

The monolithic ceramic body of the multiplier of the present invention may be fabricated from a variety of different materials such as alumina, beryllia, mullite, steatite and the like. The chosen material should be compatible with the dynode layer material both chemically, mechanically and thermally. It should have a high dielectric strength and behave as an electrical insulator.

The dynode layer to be used in the present invention may be one of several types. For example, a first type of dynode layer consists of a glass of the same generic type as used in the manufacture of conventional channel multipliers. When properly desposited on the inner passage walls, rendered conductive and adequately terminated with conductive material, it should function as a conventional channel multiplier. Other materials which give secondary electron emissive properties may also be employed.

The ceramic bodies for the multiplier of the present invention are fabricated using "ceramic" techniques.

In general, a preform in the configuration of the desired passageway to be provided therein is surrounded with a ceramic material such alumina and pressed at high pressure.

After the body containing the preform has been pressed, it is processed using standard ceramic techniques, such as bisquing and sintering. The preform will melt or burn-off during the high temperature processing thereby leaving a passageway of the same configuration as the preform.

Following shaping, the body is sintered to form a hard, dense body which contains a hollow passage therein in the shape of the previously burnt out preform. After cooling, the surface of the hollow passage may be coated by known techniques with a dynode material such as described earlier in this application.

Once the passageway has been coated with a dynode material and the aperture end and the output end has been metallized, the body may be fitted with various electrical and support connections as shown in FIG. 4 such as an input collar or flange 35, a ceramic spacer ring 34, transparent faceplate 36 having a photoemission film on its inner surface, an output flange 38, and ceramic seal 40 with a signal anode 42 attached thereto. In such configuration as shown in FIG. 4, the device functions as a phototube vacuum envelope electron multiplier.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An electron multiplier device comprising:

a monolithic electrically insulating body, at least one entrance port in said body and at least one exit port in said body, at least one hollow curved passageway through said body between said entrance and exit ports, and the walls of said hollow passageways including secondary-emissive dynode material.

2. The electron multiplier device of claim 1 wherein: said body is formed from a ceramic material.

3. The electron multiplier device of claim 2 wherein: said hollow passageway has at least one turn therein.

4. The electron multiplier device of claim 2 wherein: said passageway forms a two dimensional curve in said body.

5. The electron multiplier device of claim 3 wherein: said passageway forms a three dimensional curve in said body.

6. The electron multiplier device of claim 5 wherein: said three dimensional curve is a helix or spiral.

7. The electron multiplier device of claim 2 wherein: the entrance port is a funnel shaped portion.

8. The electron multiplier device of claim 2 wherein: said dynode material is a glass having an electrically conductive surface.

9. The electron multiplier device of claim 1 wherein: said passageway is seamless.

* * * * *